US011472589B2

(12) United States Patent
Ericson et al.

(10) Patent No.: US 11,472,589 B2
(45) Date of Patent: Oct. 18, 2022

(54) POUCH CONDITIONER

(71) Applicant: Delkor Systems, Inc., St. Paul, MN (US)

(72) Inventors: Jeremiah Ericson, Andover, MN (US); Nicholas Orfei, North St. Paul, MN (US)

(73) Assignee: Delkor Systems, Inc., St. Paul, MN (US)

( * ) Notice: Subject to any disclaimer, the term of this patent is extended or adjusted under 35 U.S.C. 154(b) by 0 days.

(21) Appl. No.: 17/476,540

(22) Filed: Sep. 16, 2021

(65) Prior Publication Data

US 2022/0089311 A1 Mar. 24, 2022

Related U.S. Application Data

(60) Provisional application No. 63/080,277, filed on Sep. 18, 2020.

(51) Int. Cl.
*B65B 61/24* (2006.01)
*B65B 63/02* (2006.01)

(52) U.S. Cl.
CPC ..... *B65B 61/24* (2013.01); *B65B 63/026* (2013.01)

(58) Field of Classification Search
CPC ..... B65B 61/24; B65B 63/026; B30B 5/06; B30B 5/067
USPC ..... 53/113, 523, 526; 100/151, 154
See application file for complete search history.

(56) References Cited

U.S. PATENT DOCUMENTS 3,120,172 A * 2/1964 Enloe ..... B65B 63/026 100/41
4,024,965 A * 5/1977 Marth et al. ..... B65G 57/245 414/907
4,271,755 A * 6/1981 Kintgen et al. ..... B65G 57/245 100/52

FOREIGN PATENT DOCUMENTS

GB 770001 A * 3/1957 ..... B65B 61/24
GB 2050987 A * 1/1981 ..... B65B 61/24
JP 04294721 A * 10/1992 ..... B65B 61/24

* cited by examiner

*Primary Examiner* — Stephen F. Gerrity
(74) *Attorney, Agent, or Firm* — Forsgren Fisher; James M. Urzedowski; Daniel A. Tysver

(57) ABSTRACT

A pouch conditioner having a roller frame positioned over a bottom conditioning belt is disclosed. The roller frame includes a housing that has a pair of opposed guide plates, between which are positioned a plurality of conditioning rollers, a top conditioning belt, and a top conditioning belt drive. The top conditioning belt is disposed about the conditioning rollers. Each of the conditioning rollers is coupled to the guide plates by a pair of actuators that provide each roller with independent articulation and individual compressive force. The distance between the bottom conditioning belt and the top conditioning belt defines a conditioning gap through which product containers are advanced. The height of the conditioning rollers relative to the bottom conditioning belt may be varied to provide a graduated conditioning gap.

12 Claims, 7 Drawing Sheets

POUCH CONDITIONER

FIELD OF THE INVENTION

Embodiments described herein are directed to a package flattener, hereinafter known as a pouch conditioner, that is utilized to provide a flexible product package with a uniform thickness, as a result of the product package being advanced between a pair of opposed, top and bottom, conditioning belts.

BACKGROUND OF THE INVENTION

When assembling or palletizing multiple product containers together for storage or shipment, it is often desirable that such containers be of a uniform size and shape. Yet, some types of packaging containers such as flexible pouches, bags, sacks and the like, when filled with granular or particulate product (e.g. sugar, salt, grain, flour, etc.) will often not have a default uniform shape or thickness suitable for their collective stacking or palletizing, despite the package container having a predetermined size and shape. As such, it would be useful to provide a system that is capable of conditioning or flattening such flexible product containers (FPCs), such that they have a uniform thickness prior to their storage or palletization.

Embodiments of the pouch conditioner described herein provide an efficient, flexible, and high-speed system that is capable of imposing a desired uniform thickness upon a given FPC. The pouch conditioner may be a stand-alone system or a component in a larger manufacturing/packaging/palletizing system such as for example of the type shown and described in U.S. Pat. Nos. 4,024,965 and 4,271,755; the entire contents of each of which are incorporated herein by reference.

SUMMARY OF THE INVENTION

Embodiments of the pouch conditioner described herein include a package conveyor for advancing filled FPCs along a packaging line or system. The packaging conveyor advances the FPCs via a bottom conditioning belt toward a conditioning assembly. The conditioning assembly is comprised of a housing containing a belt drive, and a series of rollers about which a top conditioning belt is disposed. The conditioning assembly is positioned a predetermined distance from the bottom conditioning belt so as to form a conditioning gap between the top conditioning belt and the bottom conditioning belt. This distance between the top conditioning belt and the bottom conditioning belt that defines the conditioning gap may be variable along its operational length, which is defined by the distance between the rollers at the gap entrance and gap exit. The FPCs are advanced through the gap via the co-directional movement of the bottom conditioning belt and the top conditioning belt.

In some embodiments, at least some of the rollers of the conditioning assembly, may be independently positioned relative to the bottom conditioning belt so as to allow for variations in the gap distance. In at least one embodiment the conditioning assembly is comprised of five rollers, with the first roller positioned at the gap entrance and the fifth roller positioned at the gap exit. In at least one embodiment a first of the five rollers is positioned further away from the bottom conditioning belt than the other four rollers. In at least one embodiment, a second roller is positioned to be a greater distance away from the bottom conditioning belt than any of the third-fifth rollers, but is closer to the bottom conditioning belt than the first roller. In at least one embodiment each of the third, fourth and fifth rollers are the same distance from the bottom conditioning belt. In at least one embodiment, the conditioning belt in the region extending from the third roller to the fifth roller is parallel to the bottom conditioning belt. In at least one embodiment, the two actuators disposing the roller may compress independently to allow the roller to articulate orthogonally to the roller's axis.

These and other embodiments are shown in the drawings included herewith and described in greater detail below.

DETAILED DESCRIPTION

Figure 1:
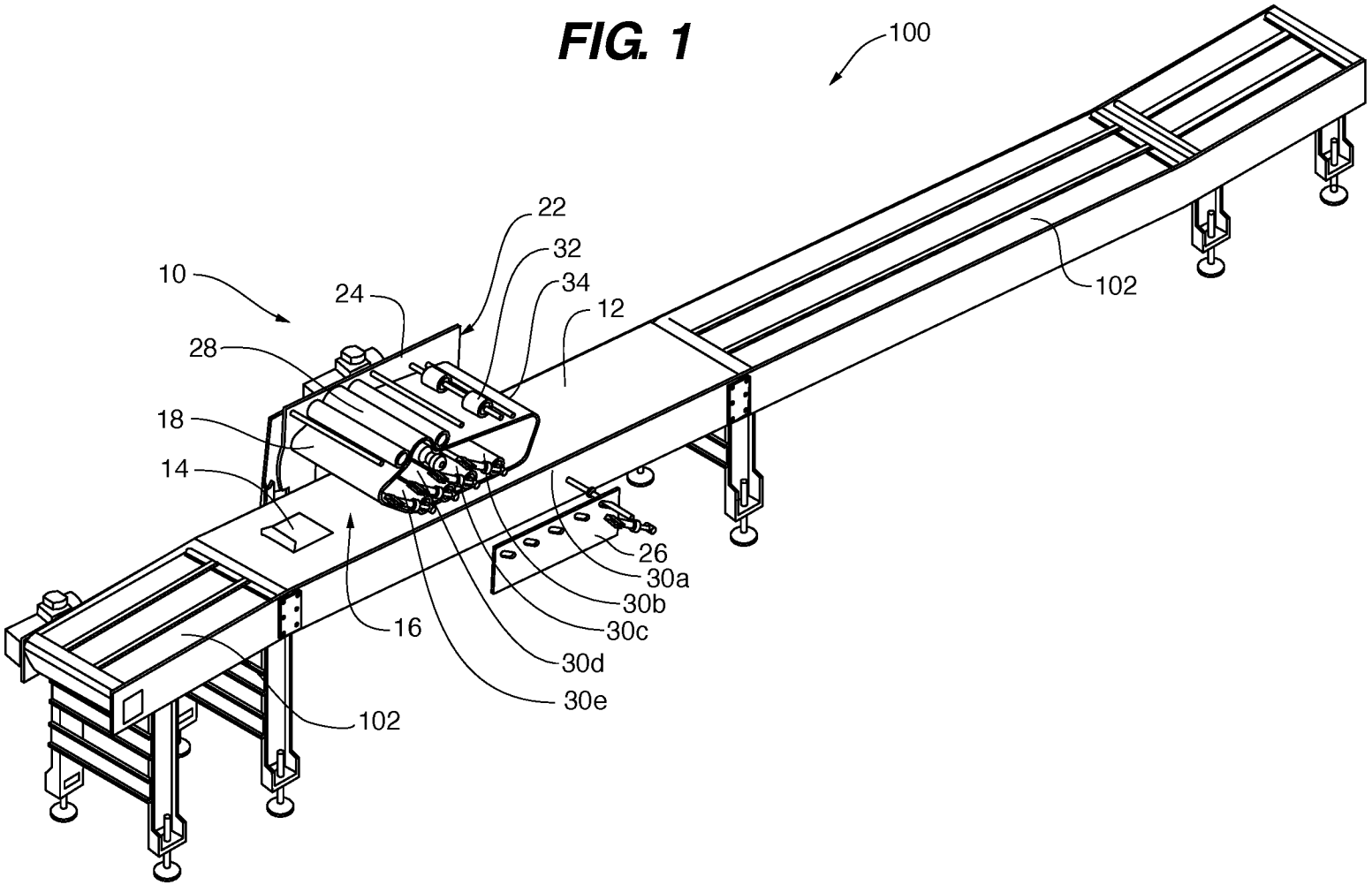
FIG. 1 is a perspective view of an embodiment of the pouch conditioner with a side of the conditioning assembly housing displaced so as to expose interior components of the assembly to view.

An embodiment of the pouch conditioner 10 is shown in FIG. 1 as part of a greater packaging system 100, that includes additional package conveyors 102 in mechanical and/or operational communication with the bottom conditioning belt 12 of the pouch conditioner 10. These conveyors 102 may advance one or more FPC 14 to the pouch conditioner 10 for conditioning, as well as draw the FPC 14 away for further downstream processing after the FPC 14 has been conditioned.

The term "conditioned" as it applies to an FPC 14, refers to the passage of an FPS 14 through a conditioning gap 16 (as defined be the distance between the bottom conditioning belt 12 and the top conditioning belt 18 mentioned above) of the pouch conditioner 10 and as a consequence of that passage having a substantially uniform thickness imposed upon the FPS 14. The manner in which an FPC 14 is conditioned by its passage through the conditioning gap is illustrated in FIGS. 4-11.

As shown in FIG. 1, the bottom conditioning belt 12 is supported by a conveyor frame 20. Positioned above the bottom conditioning belt 12 is a roller housing 22 which is comprised of two opposing roller shaft guide plates 24 and 26. The guide plates 24 and 26 are secured to opposite sides of the conveyor frame 20. The guide plates 24 and 26 support a top conditioning belt drive 28 and a series of conditioning rollers. In the embodiment shown and described herein there are five conditioning rollers 30*a*, 30*b*, 30*c*, 30*d*, and 30*e*. In some embodiments, the housing 22 also contains one or more directional or tensioning rollers 32 and guide shafts 34 that act to secure and direct the top conditioning belt 18 over the conditioning rollers 30*a*-30*e*.

For purposes of illustration and description, in the embodiment shown and described herein, guide plate 26 is shown removed so as to make the position and functioning of the conditioning rollers 30*a*-30*e* apparent.

Figure 2:
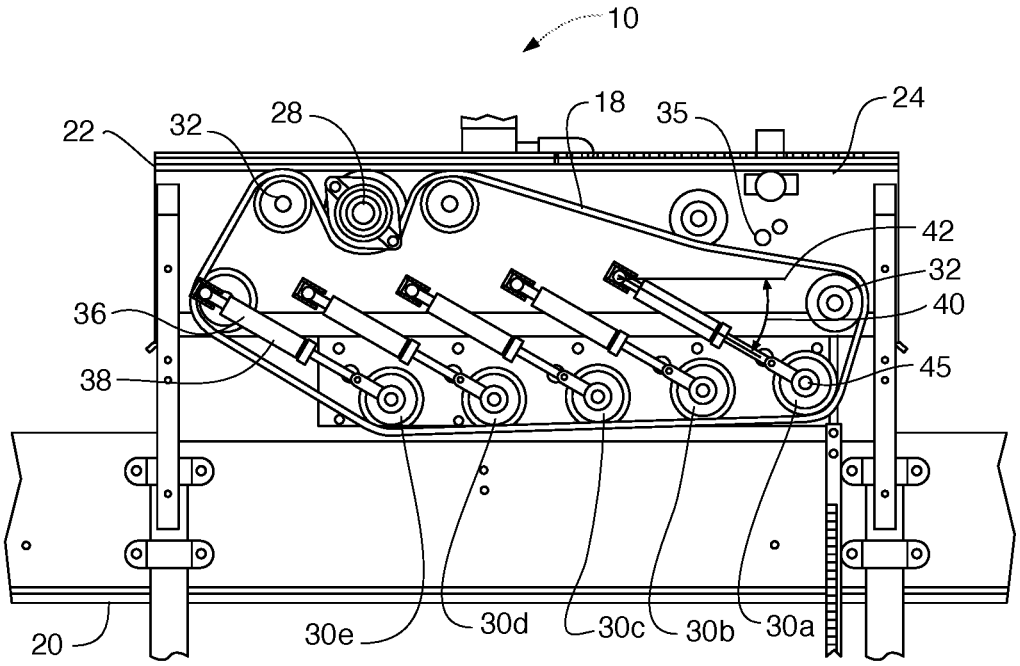
FIG. 2 is a closer side view of the exposed conditioning assembly depicted in FIG. 1.
Figure 3:
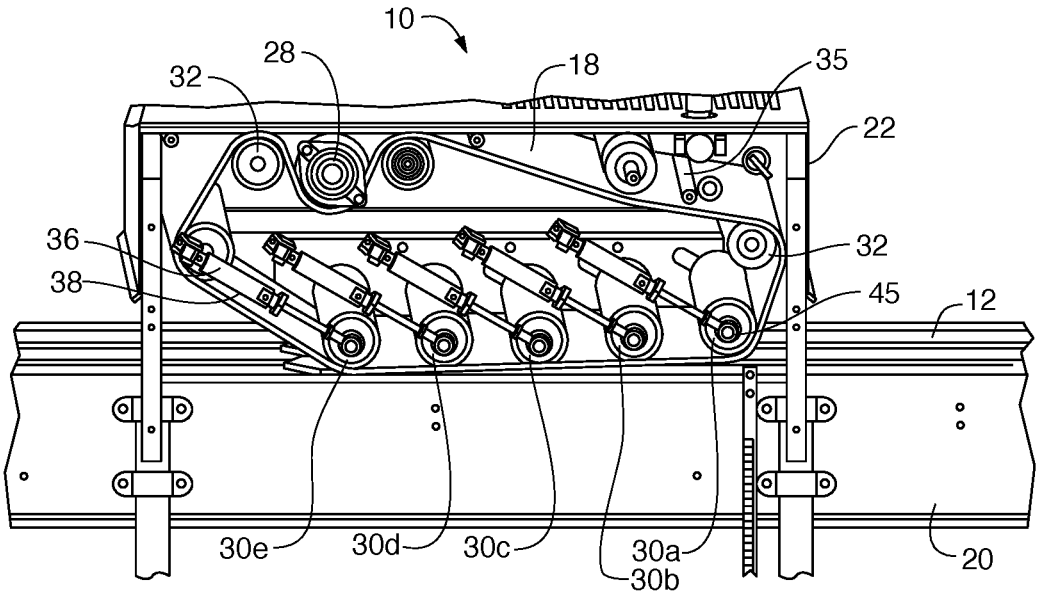
FIG. 3 shows the exposed conditioning assembly of FIG. 2 positioned above the bottom conditioning belt.
Figure 4:
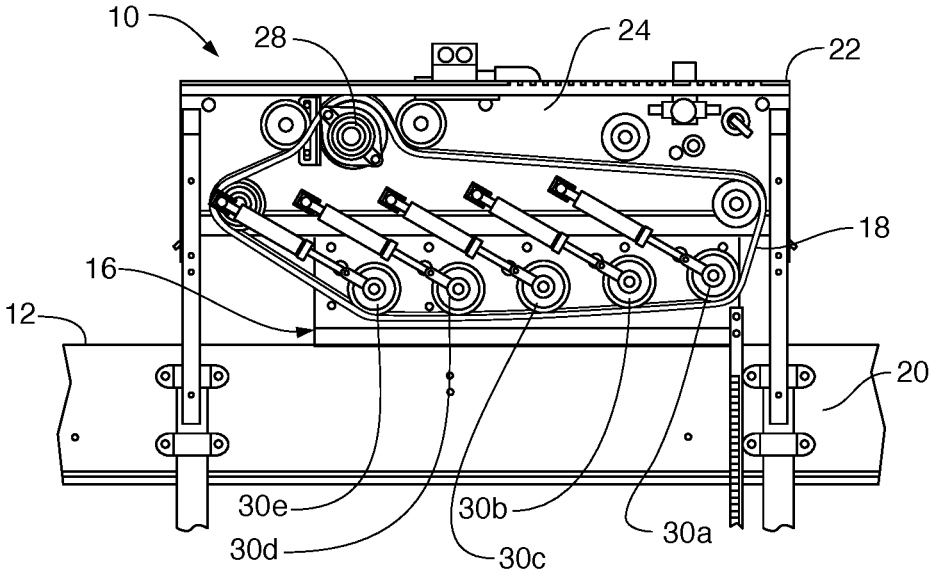
FIGS. 4-11 are a sequence of side view images depicting the advancement of an FPC through the conditioning gap and depicting the manner in which the pouch conditioner imposes a substantially uniform thickness upon the FPC as it passes through the conditioning gap.
Figure 5:
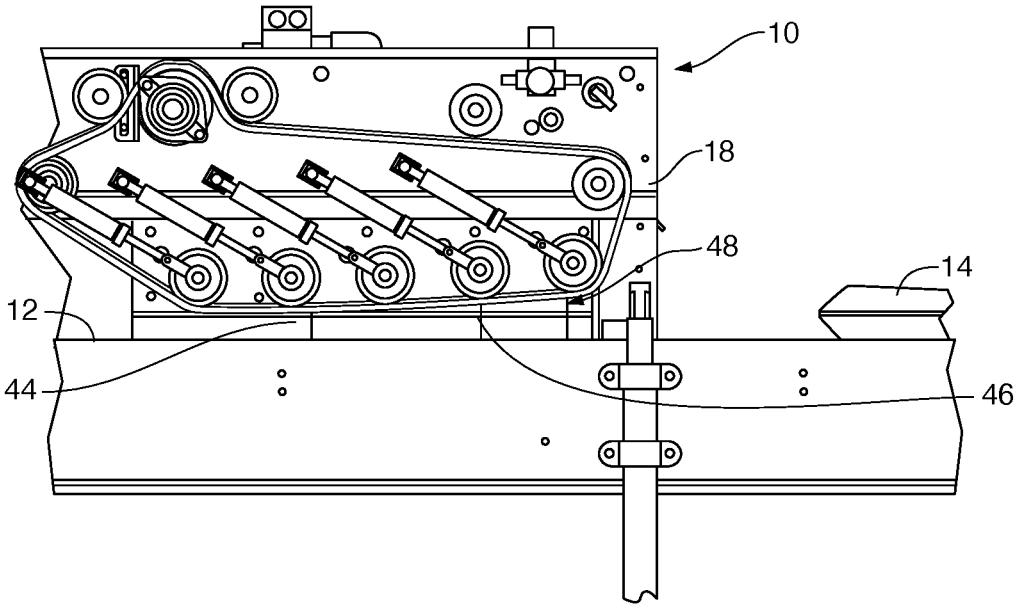
Figure 6:
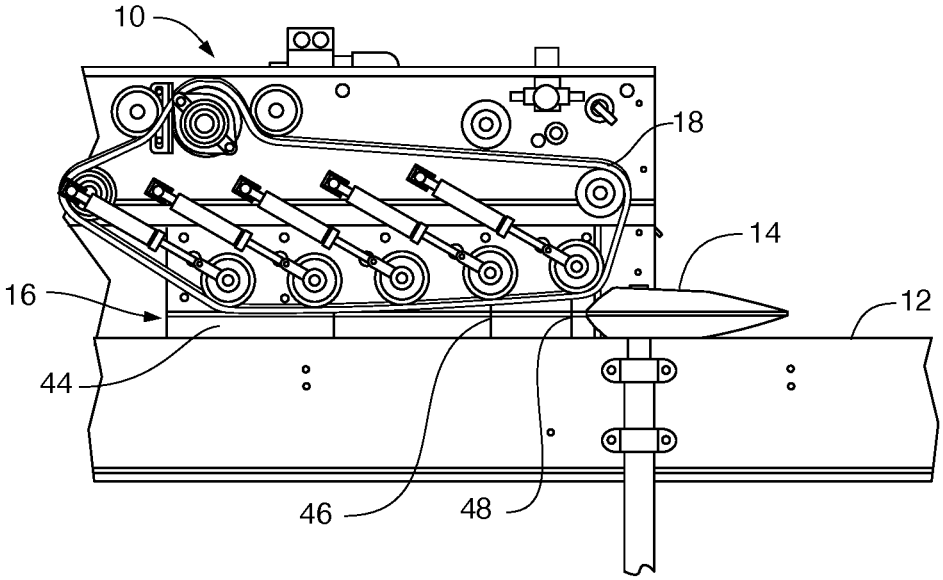
Figure 7:
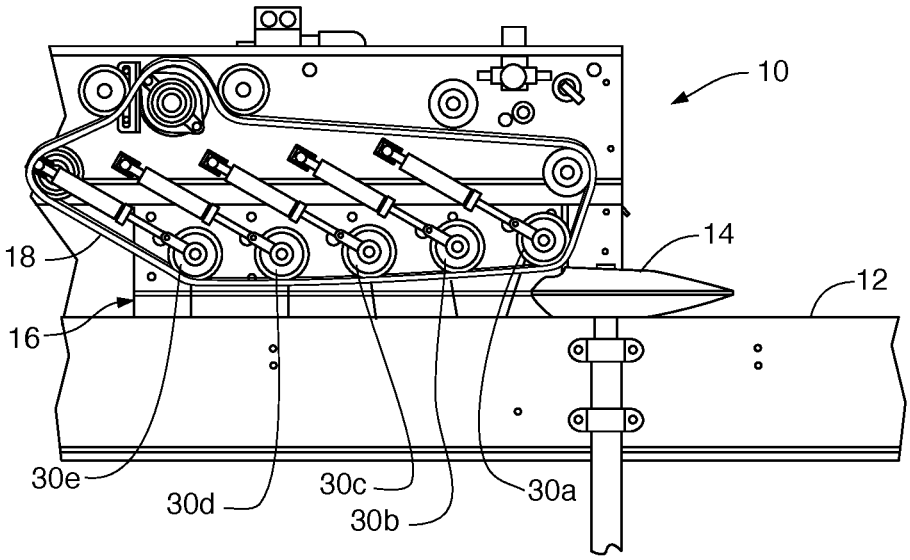
Figure 8:
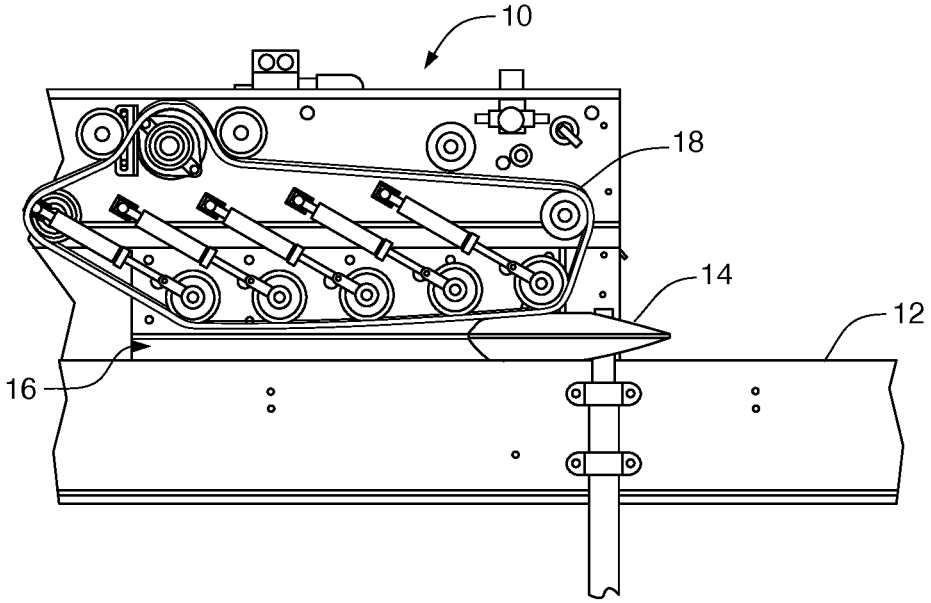
Figure 9:
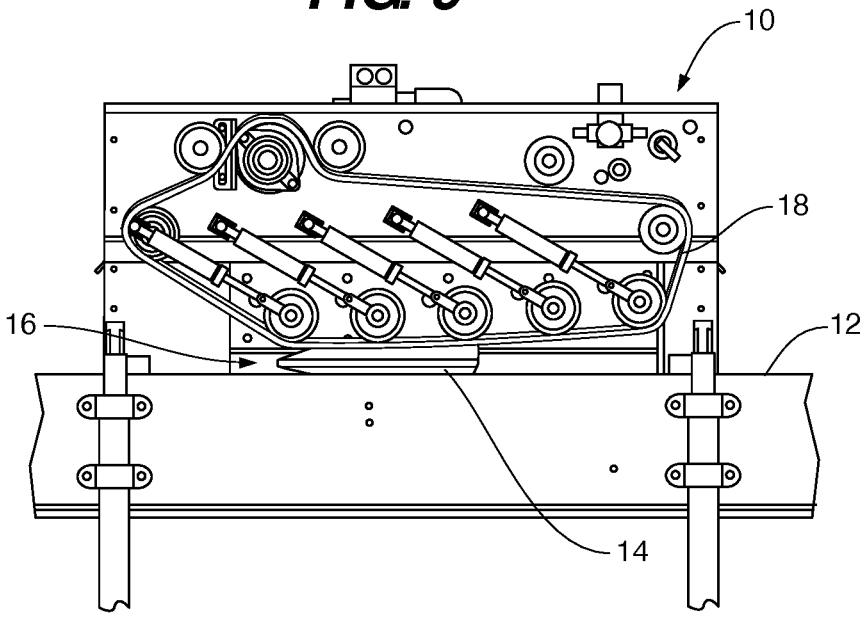
Figure 10:
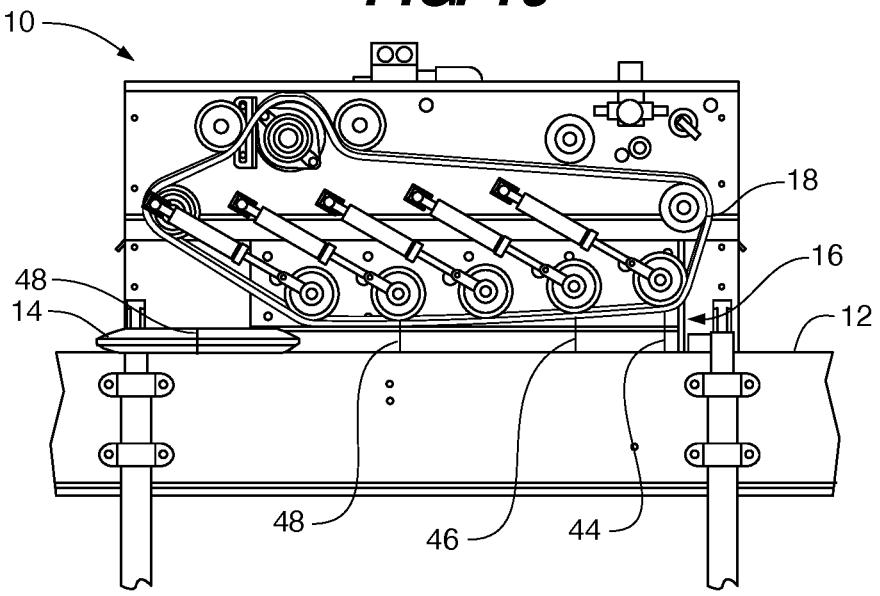
Figure 11:
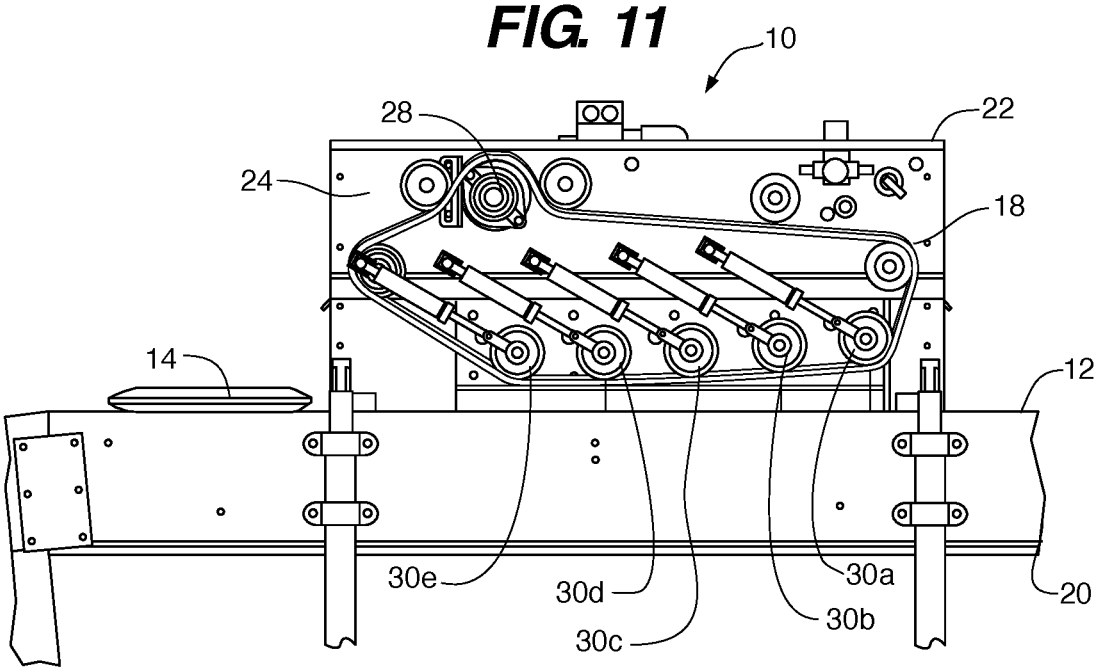

Turning to FIGS. 2 and 3, with guide plate 26 not shown, the mechanisms that are contained within the housing 22 are made visible. In this view it is readily apparent that the top conditioning belt 18 is disposed about the conditioning rollers 30*a*-30*e* and driven by a belt drive 28 which causes the top conditioning belt 18 to continuously advance. The various tensioning rollers 32 and guide shafts 35 are positioned to ensure that the top conditioning belt 18 remains in proper alignment, and in engagement with the belt drive 28 (the bottom conditioning belt 12 is likewise driven by a bottom conditioning belt drive but it is not shown).

Each conditioning roller 30*a*-30*e* is couple to each guide plate 24 and 26 by an actuator 36 (in the various figures only one side of the housing interior is shown, thus only the actuator 36 on the side depicted are visible). Each actuator 36 may be individually tuned to optimize the pouch conditioning function. By adjusting the actuators 36 vertical pressure exerted by the associated conditioning roller may be adjusted, the height relative to the bottom conditioning belt 12 (see FIGS. 4-11) may be varied, and the horizontal distance between conditioning rollers also adjusted. Each actuator 36 contains a compression cylinder 38 that compresses independently, thus allowing the supported conditioning roller to pivot somewhat orthogonally to the roller's axis. The combination of independent articulation and compression allows each conditioning roller 30*a*-30*e* to conform and apply pressure to the FPC 14 in an independent and progressive fashion.

Another unique feature that the actuators 36 provide, is a that each of the actuators 36 is provided with an angle of attack 40 of 30 degrees, relative to a horizontal plane 42 (see FIG. 2). This angle of attack 40 may be varied independently for each pair of actuators, but in at least one embodiment the angle of attack for all the actuators 36 is consistent.

In the embodiment shown, the conditioning rollers 30*a*-30*e* are provided with a diameter of 2.75 inches, though depending on the application the rollers may range from 2 inches to as much as 5 inches in diameter.

In the embodiment shown, the conditioning rollers 30*a*-30*e* are positioned five inches apart as measured from their central axis 45 (i.e. five inches on center). In some embodiments, the conditioning rollers 30*a*-30*e* are disposed apart by between 2 inches and 8 inches on center.

By adjusting the actuators 36, each of the conditioning rollers 30*a*-30*e* may be vertically repositioned up to two inches, and their angle of attack up to seven degrees.

In the embodiment shown, each of the last three conditioning rollers 30*c*, 30*d* and 30*e* are maintained at the same height 44 relative to the bottom conditioning belt 12 (see FIGS. 4-11). This height 44 defines an exit height of the pouch conditioner 10 and reflects the thickness that the conditioned FPC 14 will be imparted with upon its exit from the conditioning gap 16. The height 46 of the second conditioning roller 30*b* is 0.5 inches greater than the exit height 44. Height 46 represents a transitional height of the gap 16 between the opening height 48 of the first conditioning roller 30*a* and the lower exit height 44 of the last three conditioning rollers 30*c*-30*e*. The opening height 48 of the first conditioning roller 30*a* is 0.5 inches greater than the transitional height 46.

By gradually reducing the height of the conditioning gap 16 from the first conditioning roller 30*a* to the third conditioning roller 30*c*, the top conditioning belt 18 will apply a more graduated force to a FPC 14 passing through the gap 16 to ensure that the FPC 14 can pass through the gap 16 at relatively high speed without damage or disruption to the package or product contained therein, and be provided with a consistently reproducible package thickness 48 upon exiting the gap 16. Moreover, since each roller 30*a*-30*e* may articulate about the axis of direction of FPC 14 travel, non-uniform shapes or thicknesses may be progressively corrected in two dimensions simultaneously—the direction of travel and ninety degrees thereto—at relatively high speed without damage or disruption to the package.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A pouch conditioner comprises: a roller frame positioned over a bottom conditioning belt, the roller frame comprising:

a housing, the housing having a pair of opposed guide plates, positioned between the guide plates are a plurality of conditioning rollers, a top conditioning belt, and a top conditioning belt drive, the top conditioning belt disposed about the conditioning rollers, each of the conditioning rollers being coupled to the guide plates by a pair of actuators, each pair of actuators providing one of the conditioning rollers with independent articulation and individual compressive force;

the bottom conditioning belt and the top conditioning belt defining a conditioning gap therebetween, the conditioning gap has a conditioning gap height, the conditioning gap height is variable;

the plurality of conditioning rollers comprising at least: a first conditioning roller, a second conditioning roller, and at least two parallel conditioning rollers;

the parallel conditioning rollers are positioned above the bottom conditioning belt at the same height, the same height is an exit height, the second conditioning roller has a transitional height, the transitional height is 0.5 inches greater than the exit height, the first conditioning roller has an opening height, the opening height is 0.5 inches greater than the transitional height.

2. The pouch conditioner of claim 1, further comprising at least one tensioning roller positioned within the housing and between the guide plates, the at least one tensioning roller maintaining alignment of the top conditioning belt and engagement with the top conditioning belt drive.

3. The pouch conditioner of claim 1, wherein each of the actuators contains a compression cylinder, each compression cylinder providing independent compression from one another.

4. The pouch conditioner of claim 3, wherein each of the actuators is tunable so as to provide each of the conditioning rollers with adjustable vertical pressure.

5. The pouch conditioner of claim 4, wherein the height of each conditioning roller is variable.

6. The pouch conditioner of claim 4, wherein each of the plurality of conditioning rollers is constructed and arranged to move orthogonally to its roller axis when a flexible product container is passed between the top conditioning belt and the bottom conditioning belt.

7. The pouch conditioner of claim 1, wherein each of the pair of actuators has an angle of attack, the angle of attack being 30 degrees relative to a horizontal plane.

8. The pouch conditioner of claim 1, wherein each of the pair of actuators has an angle of attack, the angle of attack relative to a horizontal plane, the angle of attack of each pair of actuators being variable from one another by up to seven degrees.

9. The pouch conditioner of claim 1, wherein each of the conditioning rollers has a diameter of between 2 inches and 5 inches.

10. The pouch conditioner of claim 1, wherein each of the conditioning rollers are spaced apart by between 2 inches and 5 inches on center.

11. The pouch conditioner of claim 1, wherein the at least two parallel conditioning rollers comprise three parallel conditioning rollers.

12. A system for conditioning a plurality of flexible product containers comprises:

a pouch conditioner, the pouch conditioner comprising a roller frame positioned over a bottom conditioning belt, the roller frame comprising:

a housing, the housing having a pair of opposed guide plates, positioned between the guide plates are a plurality of conditioning rollers, a top conditioning belt, and a top conditioning belt drive, the top conditioning belt disposed about the conditioning rollers, each of the conditioning rollers being coupled to the guide plates by a pair of actuators, each pair of actuators providing one of the conditioning rollers with independent articulation and individual compressive force;

the bottom conditioning belt and the top conditioning belt defining a conditioning gap therebetween, the conditioning gap has a conditioning gap height, the conditioning gap height is variable;

the plurality of conditioning rollers comprising at least: a first conditioning roller, a second conditioning roller, and at least two parallel conditioning rollers;

the parallel conditioning rollers are positioned above the bottom conditioning belt at the same height, the same height is an exit height, the second conditioning roller has a transitional height, the transitional height is 0.5 inches greater than the exit height, the first conditioning roller has an opening height, the opening height is 0.5 inches greater than the transitional height; and the plurality of flexible product containers being passed through the conditioning gap, each of the plurality of flexible product containers having an initial thickness before being passed through the conditioning gap, each of the plurality of flexible product containers having a consistently reproducible package thickness after passing through the conditioning gap, the package thickness being less than the initial thickness.

* * * * *